United States Patent [19]

Credle, Jr. et al.

[11] Patent Number: 4,971,120

[45] Date of Patent: Nov. 20, 1990

[54] AUTOMATIC BEVERAGE DISPENSING SYSTEM

[75] Inventors: William S. Credle, Jr., Stone Mountain; Lawrence B. Ziesel, Marietta; Mark S. Heflin, Atlanta, all of Ga.

[73] Assignee: The Coca-Cola Company, Atlanta, Ga.

[21] Appl. No.: 375,546

[22] Filed: Jul. 3, 1989

Related U.S. Application Data

[62] Division of Ser. No. 174,742, Mar. 29, 1988.

[51] Int. Cl.[5] ..... B65B 3/04

[52] U.S. Cl. ..... 141/174; 141/1; 141/9; 141/83; 141/103; 141/129; 141/165; 141/168; 222/129.1; 222/129.4

[58] Field of Search ..... 141/1, 9, 83, 94, 100, 141/103, 129, 165, 168, 170, 174, 176, 84; 222/129.1, 129.4, 134, 2

[56] References Cited

U.S. PATENT DOCUMENTS

| | | | |
|---|---|---|---|
| 2,814,317 | 11/1957 | Gale | 141/103 |
| 3,000,408 | 9/1961 | Vischer, Jr. | 141/174 |
| 3,364,959 | 1/1968 | Herman et al. | 141/155 |
| 3,530,907 | 9/1970 | Slass | 141/167 |
| 3,688,947 | 9/1972 | Reichenberger | 222/129.1 X |
| 3,853,244 | 12/1974 | Neumann | 222/129.1 |
| 3,915,207 | 10/1975 | Greenfield, Jr. et al. | 141/129 X |
| 4,258,759 | 3/1981 | Achen | 141/100 |
| 4,590,975 | 5/1986 | Credle, Jr. | 141/1 |
| 4,628,974 | 12/1986 | Meyer | 141/129 |
| 4,641,763 | 2/1987 | Landers | 222/129.1 |

FOREIGN PATENT DOCUMENTS

| | | | |
|---|---|---|---|
| 0049963 | 4/1982 | European Pat. Off. . | |
| 635818 | 3/1962 | Italy | 222/129.1 |
| 1395702 | 5/1975 | United Kingdom | 222/129.1 |

*Primary Examiner*—Ernest G. Cusick

*Attorney, Agent, or Firm*—Thomas R. Boston; W. Dexter Brooks

[57] ABSTRACT

An automatic beverage dispensing system for use with a plurality of remote point of sale units with order entry keyboards, each having selector buttons for different flavors and cup sizes, the dispenser including an automatic cup dropper, an automatic ice dispenser, a transverse conveyor system for conveying an ice filled cup to any of a plurality of parallel lanes each having a forward conveyor system, a beverage dispenser valve associated with each of the lanes, and each forward conveyor system conveying a cup received from the transverse conveyor to a beverage fill station and then to a cup pick-up station. The dispenser can also be operated manually using buttons on the dispenser itself.

3 Claims, 17 Drawing Sheets

AUTOMATIC BEVERAGE DISPENSING SYSTEM

This is a divisional of co-pending application Ser. No. 07/174,742 filed on Mar. 29, 1988.

BACKGROUND OF THE INVENTION

This invention relates to postmix beverage dispensers and in particular to an automatic beverage dispensing system.

Various techniques are known for providing automated systems for dispensing soft drinks including the use of conveyor type systems whereby cups are automatically introduced to a continuously moving conveyor which receives the cups and processes them forward through a cup filling station, a cup capping station and a cup discharge station. The cup filling means travels forward synchronously with the conveyor belt while filling the cups and a discharge station is provided for automatically lifting and transferring the cups. Other techniques provide elaborate approaches for fulfilling each phase of a drink dispensing system such as at the ice dispensing station, the cap dispensing and sealing station and the beverage dispensing station. See prior U.S. Pat. Nos. 4,590,975; 3,530,907; 4,098,058; and 4,319,441.

It is an object of the present invention to provide an improved automatic beverage dispensing system that overcomes many of the disadvantages of the prior systems.

It is another object of this invention to provide an automatic beverage dispensing system operating with remote point of sale units with order entry keyboards, and that can alternatively be operated manually using buttons on the dispenser itself.

It is a further object of this invention to provide an automatic dispenser with two different sets of conveyor systems, including a transverse conveyor and a plurality of straight, parallel, forward conveyors.

It is a still further object of this invention to provide an automatic dispensing system with a transverse conveyor for carrying cup cradle from a cup drop and ice drop station to one of a plurality of forward conveyors, which then carry the ice-filled cup to a fill station and then to a pick-up station.

It is another object of this invention to provide an automatic control system for an automatic dispenser which includes means for automatically dropping the selected size of cup and then conveying it through a plurality of stations to final pick-up station whereby the correct amount of ice and the correct beverage and the correct quantity of beverage is dispensed into the cup.

SUMMARY OF THE INVENTION

An automatic beverage dispensing system comprising a beverage dispenser including a housing, a transverse conveyor system for conveying ice filled cups sideways inside the housing from a cup drop station to a transfer station on any one of a plurality of parallel lanes each having a forward conveyor system, the forward conveyor systems conveying ice-filled cups forward toward the front of the housing from a transfer station to a beverage fill station, and then to a cup pickup station, an automatic cup dropper assembly including a plurality of cup holders each adapted to hold a plurality of different size cups for placing a cup of the desired size into a cup cradle of the transverse conveyor system at a cup drop station thereof, an ice bin inside the housing including an automatic ice dispenser for dispensing the desired quantity of ice into a cup at the cup drop station, a beverage dispensing valve located at the beverage fill station of each of the forward conveyor systems for dispensing beverage into a cup located at the beverage fill station, and the forward conveyor systems each including means for conveying filled cups from said fill station forward to said cup pick-up station.

BRIEF DESCRIPTION OF THE DRAWINGS

The present invention will be more fully understood from the detailed description below when read in connection with the accompanying drawings wherein like reference numerals refer to like elements and wherein:

FIGS. 13A, 13B and 13C are electrical wiring diagrams of the electrical control system of this invention.

DETAILED DESCRIPTION OF THE PREFERRED EMBODIMENTS

Figure 1:
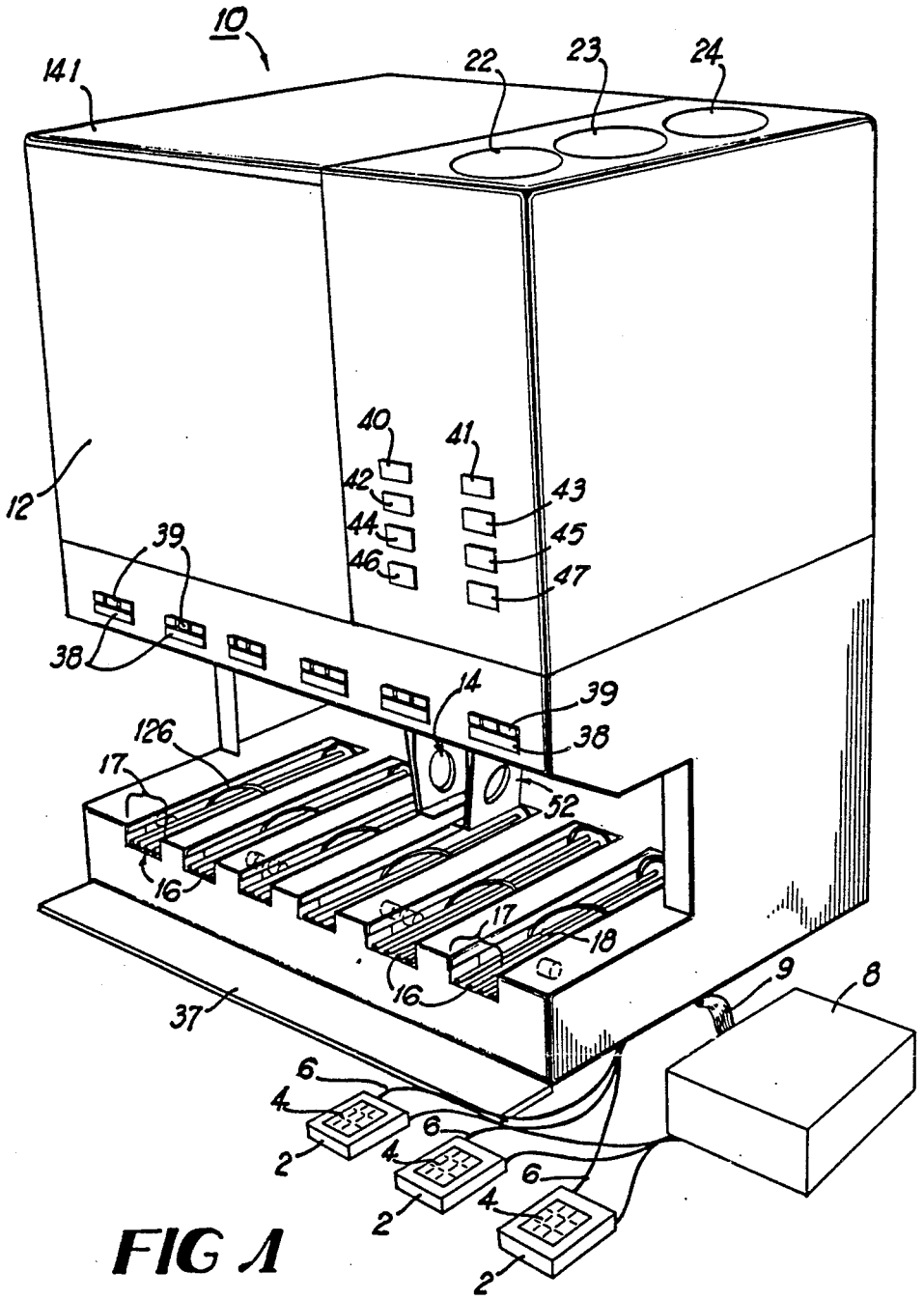
FIG. 1 is a perspective view of the automatic beverage dispensing system of present invention.

With reference now to the drawings, FIGS. 1–9 show the automatic beverage dispensing system 10 of the present invention.

The dispenser 10 includes a housing 12, a first (or transverse) conveyor system 14, a plurality of second (or screw or forward) conveyor systems 16 each operating on one of a plurality of parallel and separate lanes 17 including a cup supporting surface 18, an automatic cup dropper assembly 20 including a plurality of cup holders 22, 23, and 24, for dropping a cup 25 of the desired size onto the transverse conveyor system 14 at a home position or cup drop station 26 thereof, an ice dispensing assembly 27 including an ice bin 28 and an automatic ice dispenser 30, a beverage dispenser valve 32 located above a beverage fill station 34 on each of the forward conveyor systems 16, and a cup pick-up station 36 at the front end of each lane 17 where the filled cup is easily accessible to be picked up by an operator. The dispenser 10 also preferably includes a shelf 37 on the front thereof, so that one operator can move a filled cup (that has not yet been picked up by another operator who ordered it) from a pick up station 36 and place it on the shelf 37 so that the next cup in line will be automatically conveyed forward to the pick up station.

The automatic beverage dispensing system of this invention includes the dispenser 10, a plurality of POS (point of sale) units 2 each including an order entry keyboard 4 and each being electrically connected by leads 6 to a PLC or programmable logic controller 8, which is in turn electrically connected, by line 9, to the dispenser 10. The operation of the electrical control system of this invention will be described below with reference to FIGS. 10–13.

In addition to the three openings to the cup holders 22, 23, and 24 on the top right hand side of the housing, the housing includes a plurality of buttons and lights. As shown in FIG. 1, over each lane 17 is one pour/cancel button 38 for that flavor and three portion control buttons 39 for three cup sizes. These buttons are to be used for manual operation of the dispenser 10, that is, when automatic operation is not working or is not desired. A cup of the desired size is placed manually under the valve of the selected conveyor (for the selected flavor) and the pour/cancel button is pushed and held or the size button is pushed to automatically dispense that quantity of beverage (by means of a standard portion control) into the cup, which is then manually picked up by the operator.

In addition to these buttons, there are two columns of buttons and lights on the right front of the housing 12. These include a cup jam light 40, a low cup light 41, a screw (second) conveyor light 42 (to indicate a fault in one of the second conveyors 16), a transverse (first) conveyor light 43 (to indicate a fault in the first conveyor 14), a low ice light 44, an alarm/reset button 45, an automatic or manual button 46, and a power-on button/light 47.

The first or transverse conveyor system is shown in FIGS. 3, 4, 5 and 7 and includes an elongated lead screw 50, a cup cradle 52, a bracket 54 supporting the cradle 52, a guide track 56, rollers 58, a motor 60, and a pulley 62, a belt 64, support means 66, an electric eye 68, and an encoder 70. The electric eye is a standard type of single unit that includes both the transmitter and receiver.

The transverse conveyor preferably moves the cradle 52 at a speed of about fifteen inches per second. An electrical brake 61 is connected to the rear of the motor 60 to ensure that the cradle 52 stops at exactly the correct location.

The bracket 54 includes an internally screw threaded follower 71 that moves as the lead screw rotates and carries the bracket and cradle with it. When the cradle 52 has been moved to the transfer station over the cup surface of the second conveyor system that corresponds to the selected beverage, the cradle opens and drops the cup onto the surface 18. The second conveyor system then moves the cup forward of the housing to the fill station and the cradle 52 then closes and returns to the cup drop station.

Figure 5:
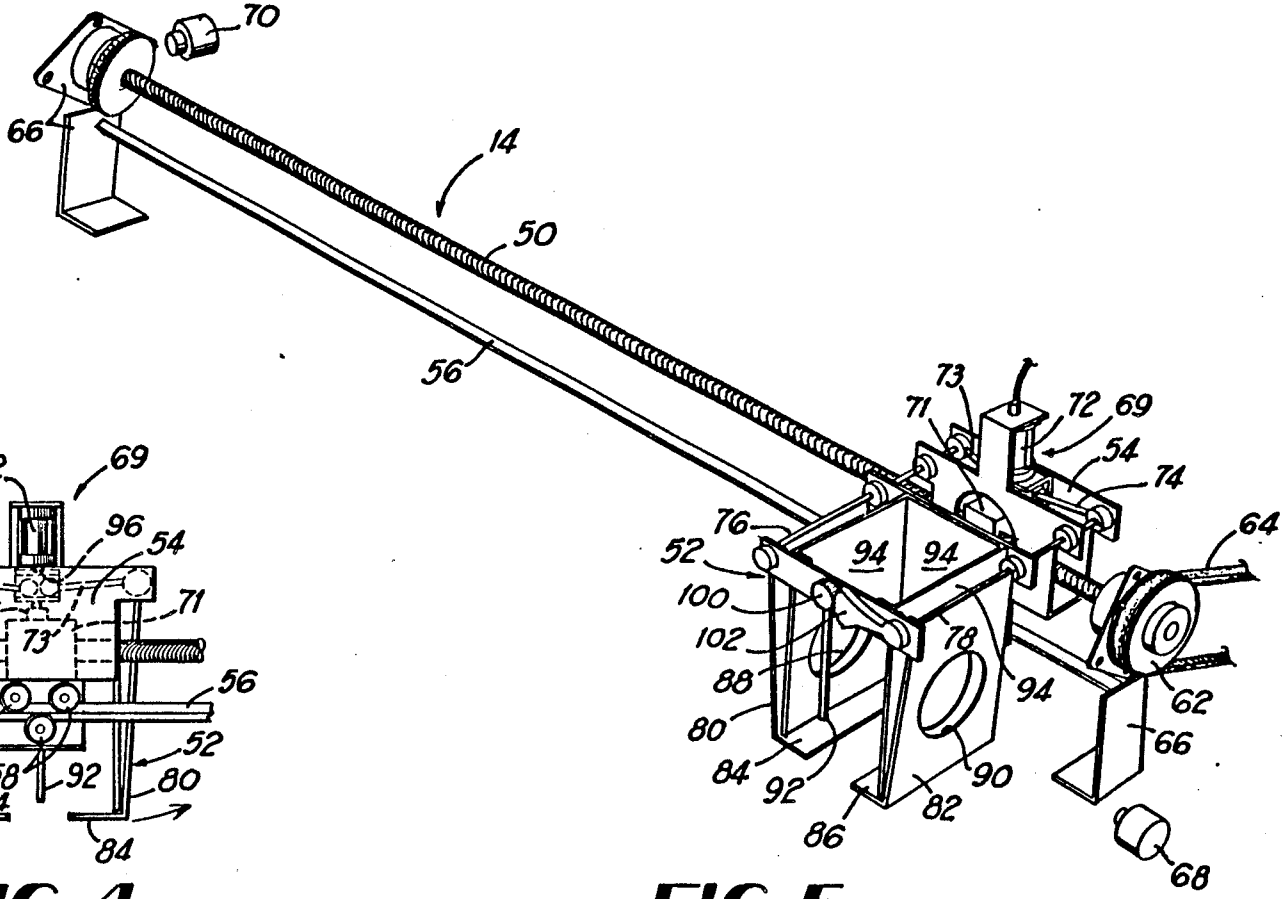
FIG. 5 is a perspective view of the transverse conveyor system.
Figure 4:
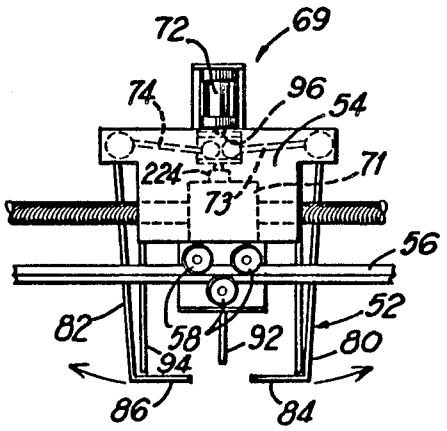
FIG. 4 is a partial rear view of part of the first conveyor system showing the cup cradle.
Figure 6:
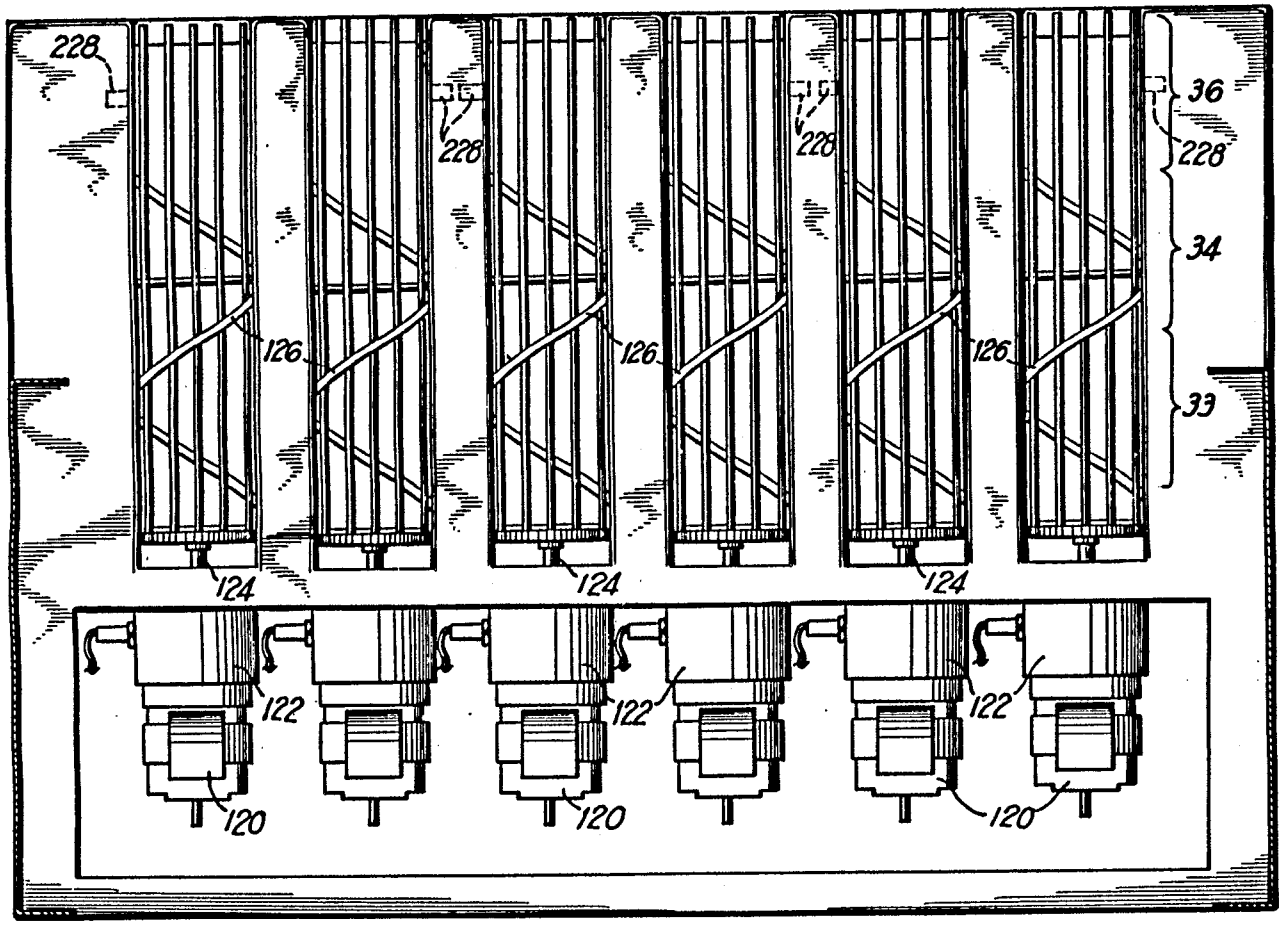
FIG. 6 is a top plan view showing the plurality of forward conveyor systems.

FIGS. 4 and 5 show the cup drop mechanism 69 for dropping a cup 25 from the cradle 52 including an air cylinder 72 mounted on the bracket 54, pivot arms 73 and 74 connected to rotatable shafts 76 and 78 connected to the movable cup support walls 80 and 82 of the cradle. Each wall 80 and 82 has a cup supporting flange 84 and 86, respectively, at the bottom thereof and a hole 88 and 90 therein for the light beam of the electric eye 68. The cradle 52 also has a finger 92 to keep the cups from falling out of the front of the cradle. The cradle 52 also includes an internal three wall cup positioner 94, with holes mating with holes 88 and 90, but with no bottom cup support. The cup is supported in the cradle solely by the cup support flanges 84 and 86 on the movable walls 80 and 82.

When the cup is to be dropped, air is fed to the air cylinder 72 through a hose 104 from a solenoid controlled valve 75 causing a plunger 96 and a yoke 97 connected to the plunger 96 to move down pushing the arms 73 and 74 down and causing the movable walls 80 and 82 to pivot out dropping the cup.

The finger 92 is also pivoted out of the way by the mating gears 100 and 102; the gear 102 is connected to the shaft 78. The finger moves out of the way so that the second conveyor system can move the cup forward on the surface 18 to the fill station. After the cup 25 has been so moved, the air to the air cylinder 72 is shut off, a spring (not shown) in the air cylinder 72 withdraws the plunger 96, and yoke 97 then is pulled up by such spring, pulling the arms 73 and 74 up thus causing the walls 80 and 82 to pivot back into a position in which they are ready to receive and hold the next cup to be dispensed.

The encoder 70 senses how far the cradle has moved and this information is used to control the motor 60 to control how far to carry the cradle and how far back to return it.

The support means 66 holds the guide track 56, the lead screw 50 and the pulley 62. The rollers 58 are mounted on the bracket 54 and ride on the track 56 to properly position the cradle.

The second or forward conveyor systems 16 are shown in FIGS. 1, 2, 3, 6, and 7 and each includes a cup surface 18, an electric motor 120, a gear reducer 122, a drive shaft 124 driven by the gear reducer, and a cup moving helix 126 connected to the drive shaft 124. The cup surface 18 includes three separate stations, namely, the cup transfer station 33, the beverage fill station 34, and the cup pick-up station 36. As the helix 126 rotates, any cup 25 sitting on the cup surface 18 will be advanced forward of housing 12 by the rotation of the helix. The helix rotates counterclockwise looking at it from the rear of the dispenser 10.

The forward conveyors 16 preferably move a cup forward at four and one-half inches per second, which is one revolution per second. The motor 120 is preferably a shaded-pole gear motor with integral brake.

Figure 3:
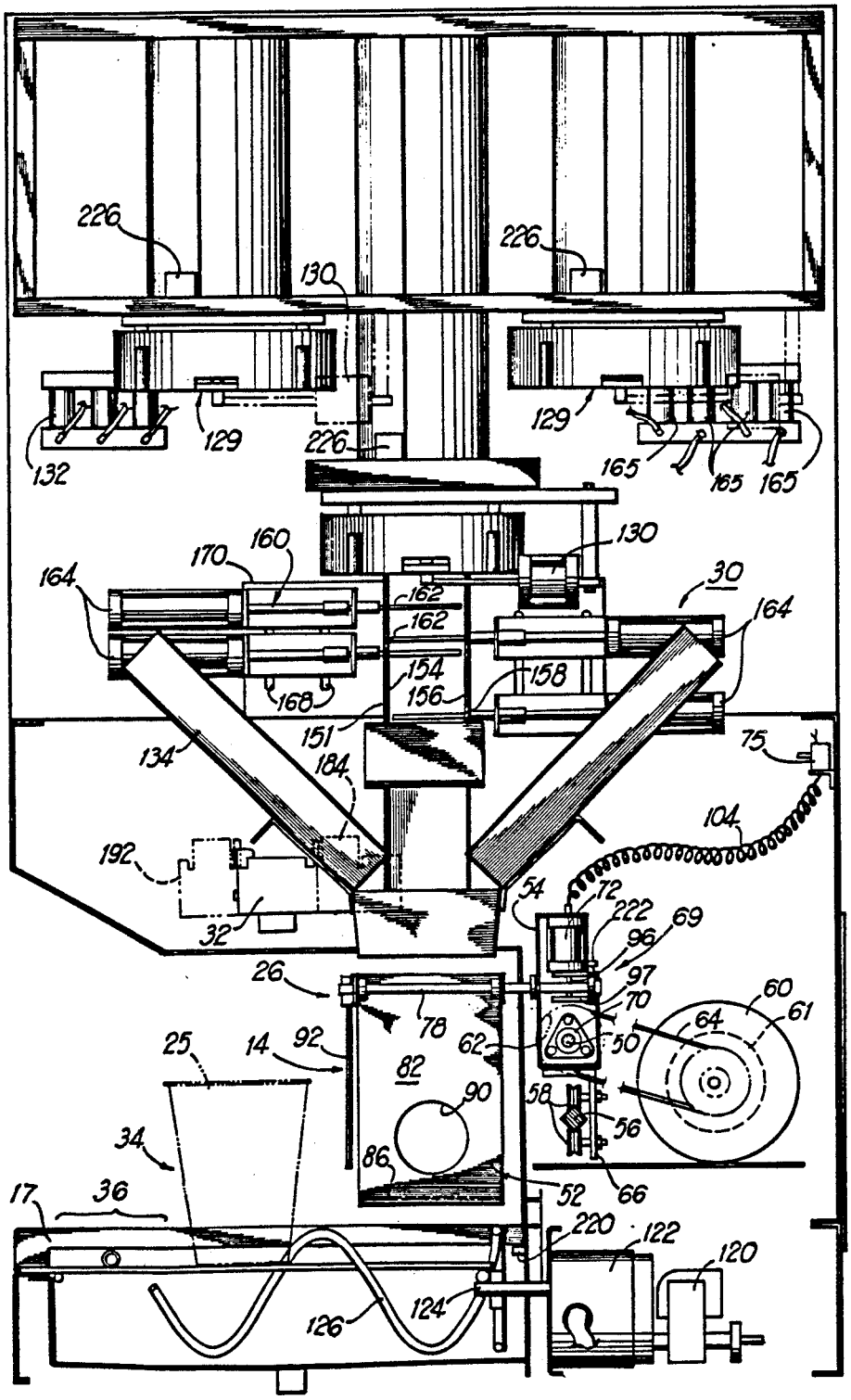
FIG. 3 is a partly cross-sectional, partly broken-away right side view of the dispenser of FIG. 1.

The cup cradle 52 is oriented to move perpendicular to the cup surfaces 18 and in line with each of the transfer stations 33 of each of the second conveyor systems 16. As shown in FIG. 3, when a cup 25 has been advanced by a second conveyor system from the cup transfer station to the cup fill station, it is completely ahead of the cradle 52, which can then be returned to the cup drop station.

Figure 2:
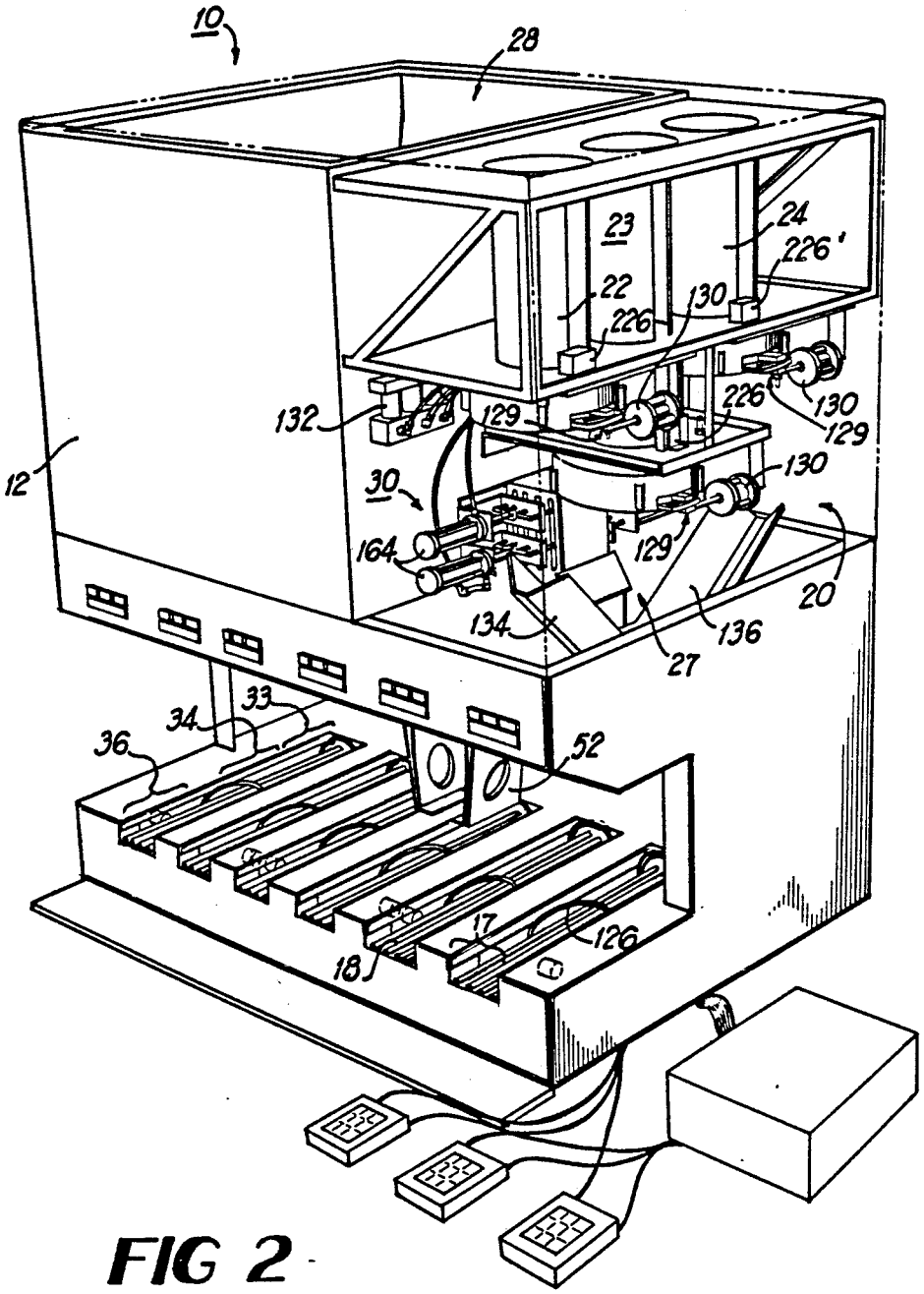
FIG. 2 is a perspective view of the dispenser shown in FIG. 1, but with part of the housing removed to show the automatic cup dropper assembly and the automatic ice dispenser.

The automatic cup dropper assembly 20 includes the three cup holders 22, 23, and 24 for holding, for example, regular, medium and large size cups 25. Any well-known cup dropping mechanism can be used with each of the cup holders. As shown in FIGS. 2 and 3, an automatic cup dropping mechanism 129 can be used with each cup holder, that includes an air cylinder 130 and an electric solenoid controlled valve 132 for controlling the air flow to the air cylinder. When an air cylinder has been energized, its plunger retracts and allows one cup to drop while then retaining the next cup in the stack. Since this mechanism is old and well-known and forms no part of the present invention, it need not be described in detail herein. FIG. 3 shows three solenoids 132, one for each of the three air cylinders for the cup holders.

When a cup has been dropped from one of the holders 22, 23 or 24, it falls into the cup cradle 52 at the cup drop station 26, either straight down from holder 23 or down one of the cup chutes 134 or 136. The electric eye 68 determines when a cup has been dropped into the cup drop station. This electric eye is a single unit that includes both the transmitter and receiver.

The ice dispensing assembly 27 includes an ice bin 28 and an automatic ice dispenser 30 for dispensing a selected quantity of ice into a cup 25 located at the cup drop station 26. The quantity of ice for each size cup can also be easily adjusted, if desired. The ice bin 28 is a standard type of ice bin with an auger 142 in the bottom thereof driven by a motor 144, a gear train 146 and a drive shaft 148 connected to the auger for moving ice toward an ice dispensing chute 150.

The automatic ice dispenser 30 will now be described with reference to FIGS. 2, 3, 7 and 9. The ice chute 150 includes a vertical portion 151 with a plurality of vertical slots 152 in opposing walls 154 and 156 thereof, and a plurality of openings 158 in only the rear wall 156 thereof.

Four retractable ice holders 160 are connected to the chute 150. The ice holders are identified from the top down as the large, medium, regular and bottom holders. Each ice holder includes retractable fingers 162 that extends into the chute 150 through the slots 152 or the openings 158. Fingers 162 are retracted by an air cylinder 164 when energized (when the air is ON). When the air is OFF, a spring in the air cylinder pushes the fingers forward into the chute. Each of the retractable ice holders includes an air cylinder 164 and an electric solenoid controlled valve 165 for controlling the flow of air to the air cylinder. FIG. 3 shows four solenoid valves 165, one for each of the four air cylinders controlling the retractable ice holders.

In the normal condition, the bottom fingers are closed (inserted) and the others are open (retracted). If a large cup is selected, the large (or uppermost) fingers 162 are inserted (the air is turned OFF) and the bottom fingers are then retracted (by turning the air ON to the bottom set of fingers), thus dispensing a large quantity of ice into a cup 25. The bottom fingers are then re-inserted and the top fingers retracted to return the automatic ice dispenser to its normal condition.

A similar operation occurs for dispensing regular and medium quantities of ice.

Figure 9:
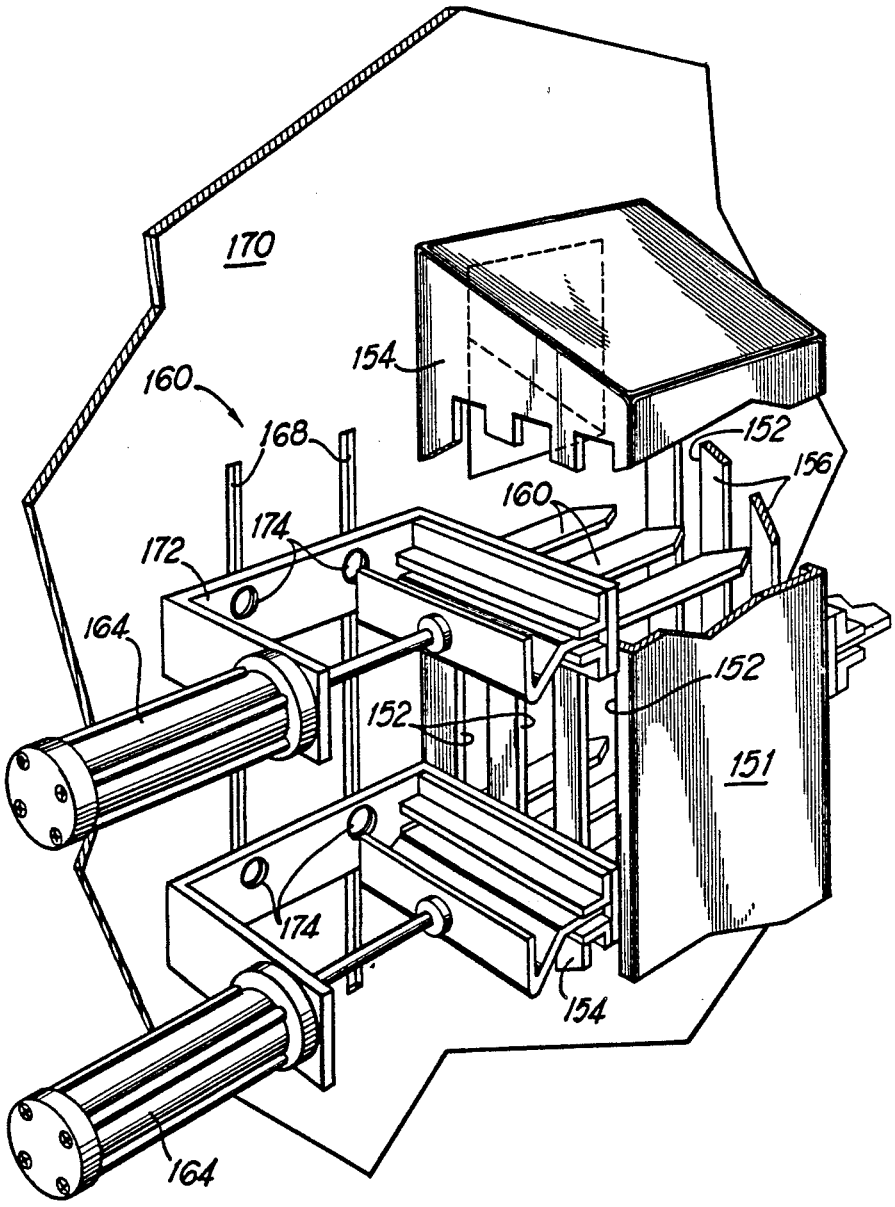
FIG. 9 is a partial, perspective view of the cup dropper assembly showing the adjustability thereof.

According to the present invention, the quantity of ice dispensed can be easily adjusted. FIG. 9 shows the vertical slots 152 and also vertical slots 168 in the support 170. The top three ice holders 160 are each mounted on a bracket 172 connected by screws 174 to the support 170. By loosening the screws 174, the brackets can be moved up and down and thus the location of the fingers relative to the bottom fingers can be moved up or down thus adjusting the quantity of ice that will be dispensed.

Normally the air is on ON for the regular, medium and large fingers (the uppermost three sets of fingers) and the air is OFF for the bottom fingers. To dispense a large quantity of ice, the air is turned off for the top set of fingers and on for the bottom set of fingers.

Figure 7:
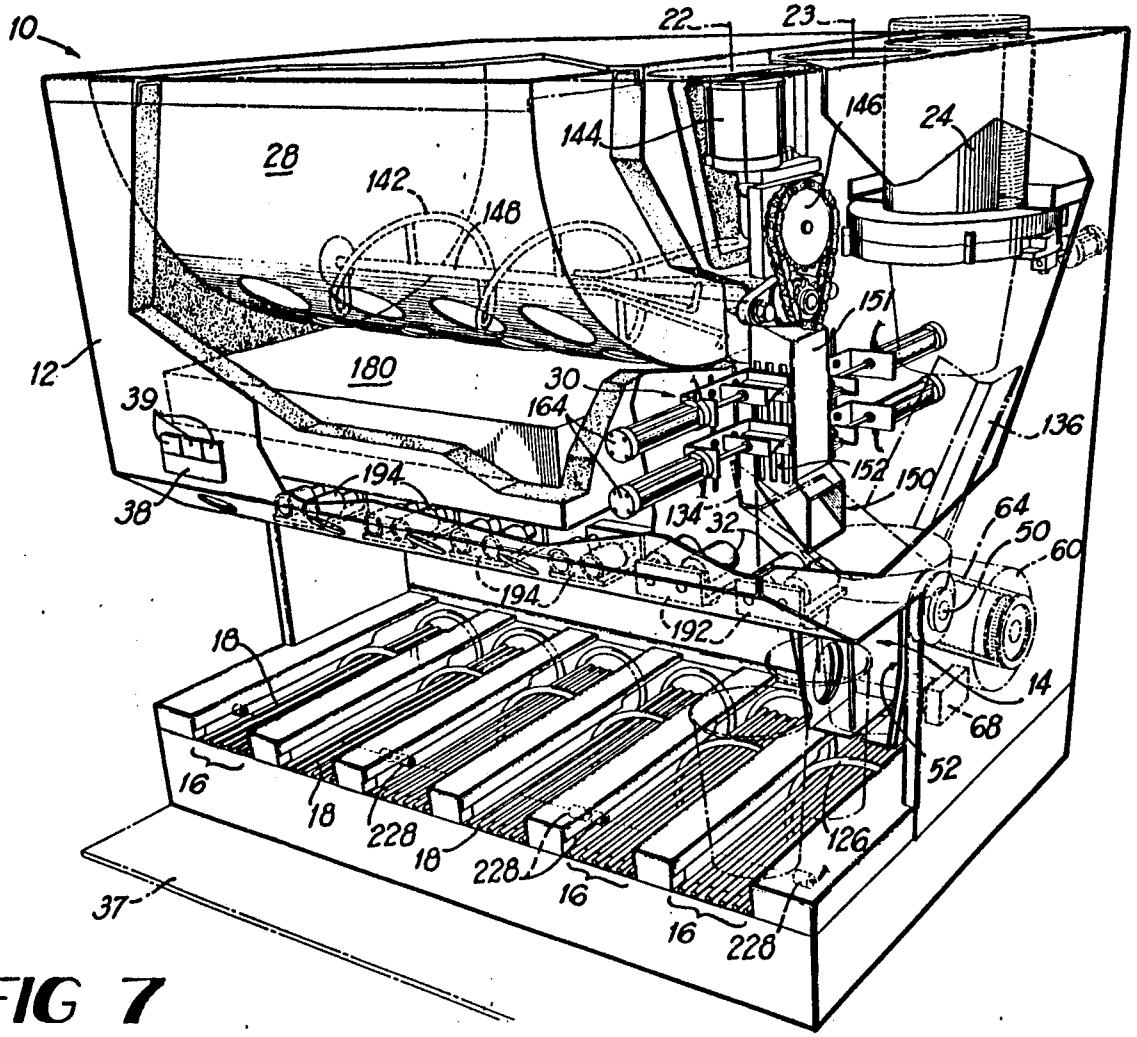
FIG. 7 is a perspective view of part of the dispenser of the present invention as shown in FIG. 1, partly broken away to better show certain features of the dispenser.
Figure 8:
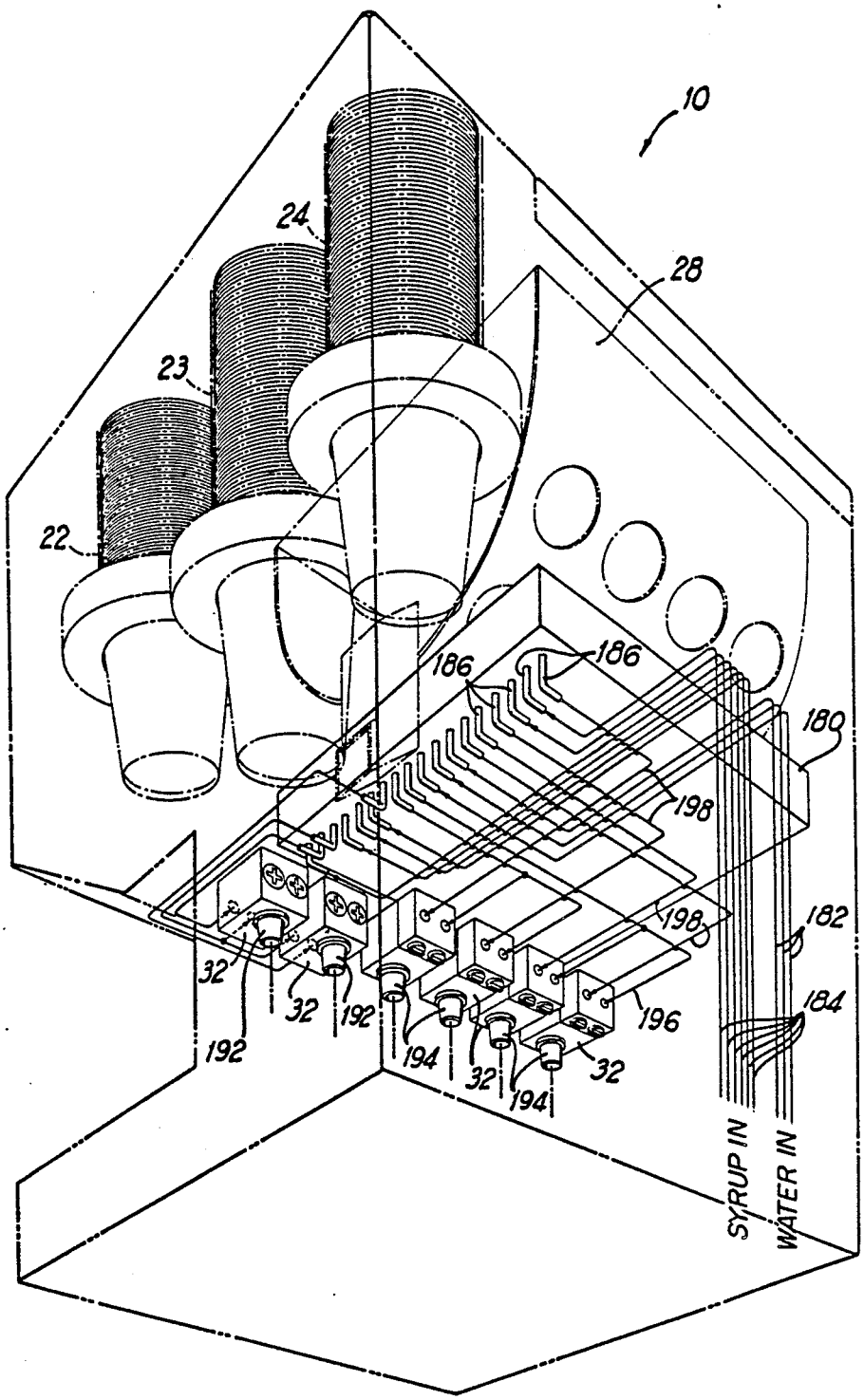
FIG. 8 is a partly schematic perspective view showing the beverage dispenser valves from below and behind the valves.

The beverage dispensing valves 32 and the fill station 34 will now be described with reference to FIG. 3, 7 and 8. A beverage dispensing valve 32 which can be of any well-known type is located directly over the cup surface 18 of each of the second conveyor systems 16 at the fill station 34 thereof. As shown in FIG. 8, because of the room required by the ice chutes, there is not enough room left for the two right-most valves (as viewed in FIG. 1) to be located in the same way as are all the other four left-most valves. To solve this problem, the right-most two valves are reversed, as shown in FIG. 3. In addition, there is no room for the valve block for these two right-most valves, and so it is left off. An ON/OFF valve can be located elsewhere in the housing 12 for these two right-most valves. The valve block 192–193 for the other valves is shown in FIG. 3. The reversed valves are shown at 192 and the normal valves (the four left-most valves) are shown at 194–194. The valves 32 can each be for a different beverage or there can be two or more for the same, more popular, beverage.

The ice bin 28 includes a cold plate 180 in the bottom thereof below the auger, as shown in 6, 7 and 8. The ice bin includes a cover 141 that is easily removed for adding ice to the ice bin. The automatic beverage dispenser 10 includes, for the six valves 32, three water-in lines 182 and six syrup-in lines 184. Each of these lines goes into one of eighteen connectors 186 attached to the bottom surface of the cold plate 180. Three of these connectors are connected to water-out 196 lines and six are connected to syrup-out lines 198. Each water line serves two valves, and there is one syrup line for each valve. Inside the cold plate are the cooling coils (not shown) for the three water lines and the six syrup lines.

It is noted that the dispenser 10 includes eight proximity switches and ten photoswitches. Of the eight proximity switches, six proximity switches 220 are located one each adjacent the coupling between each of the motors 122 and the helix 126 to sense when the shaft (or helix) makes one full turn. One proximity switch 222 senses when the cradle 52 is in its home position (the cup drop station) and is located adjacent to the follower 71 when the follower is in its home position. The last proximity switch 224 is positioned on the cradle mechanism to travel with it and is positioned adjacent to the yoke 97 to sense whether the cradle is opened or closed.

Regarding the ten photoswitches, three photoswitches 226 are located one each adjacent the cup holders 22, 23 and 24 to sense when they are empty for turning on the low cup light 41. Six more of the ten photoswitches 228 are located one each at the end of each lane adjacent the pick-up station to sense whether or not a cup is located at this station. The last photoswitch is photoswitch 68 located to sense whether or not a cup is in the cradle 52.

In operation, an operator will press two buttons, one for the size and one for the flavor. The electronics activates the cup dropper 20 for the selected size cup which is then dropped into the cup cradle 52 at the cup drop station 26. The electric eye identifies when a cup is in position and the automatic ice dispenser is then activated to dispense the correct amount of ice into the cup.

After the ice has been dispensed, the first (or transverse) conveyor system 14 is activated (after a short time interval after the ice is dispensed) to move the ice filled cup to that one of the second (or screw) conveyor systems 16 that corresponds to the selected flavor and drops the cup onto the surface 18. The encoder 70 determines when the first conveyor system has moved the correct distance. When the cradle 52 stops, the-cup drop mechanism 69 is energized to drop the cup onto the surface 18. The cup drop mechanism stays open until the second conveyor system advances the cup from the transfer station to the fill station. The cup drop mechanism then returns the cradle to its normal condition and then the first conveyor system 14 returns the cradle to the cup drop station.

After the second conveyor systems delivers the cup to the fill station, the beverage dispensing valve is energized to dispense the correct quantity of beverage into the cup. After the valve is de-energized, the second conveyor system is then energized to advance the cup to the cup pick-up station 36, unless of course another cup is already there.

The following is a description of the electronics and of the program used to operate the automatic beverage dispenser 10.

Figure 10:
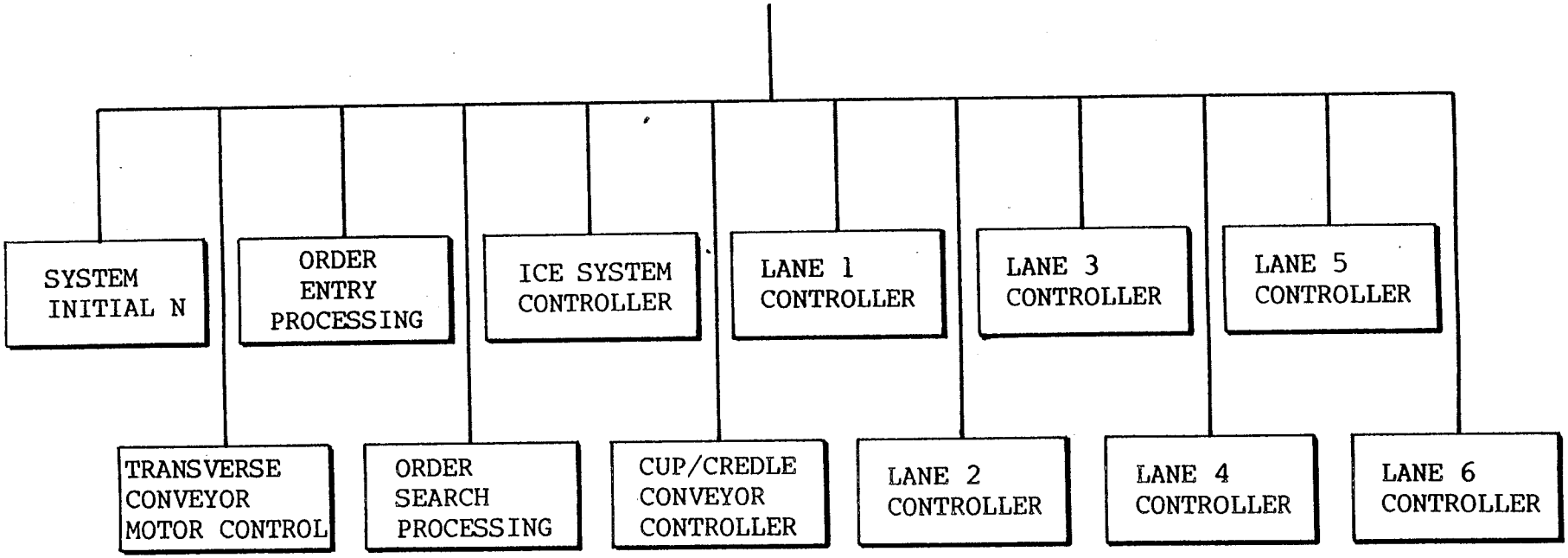
FIG. 10 is a block diagram of the control program.
Figure 11A:
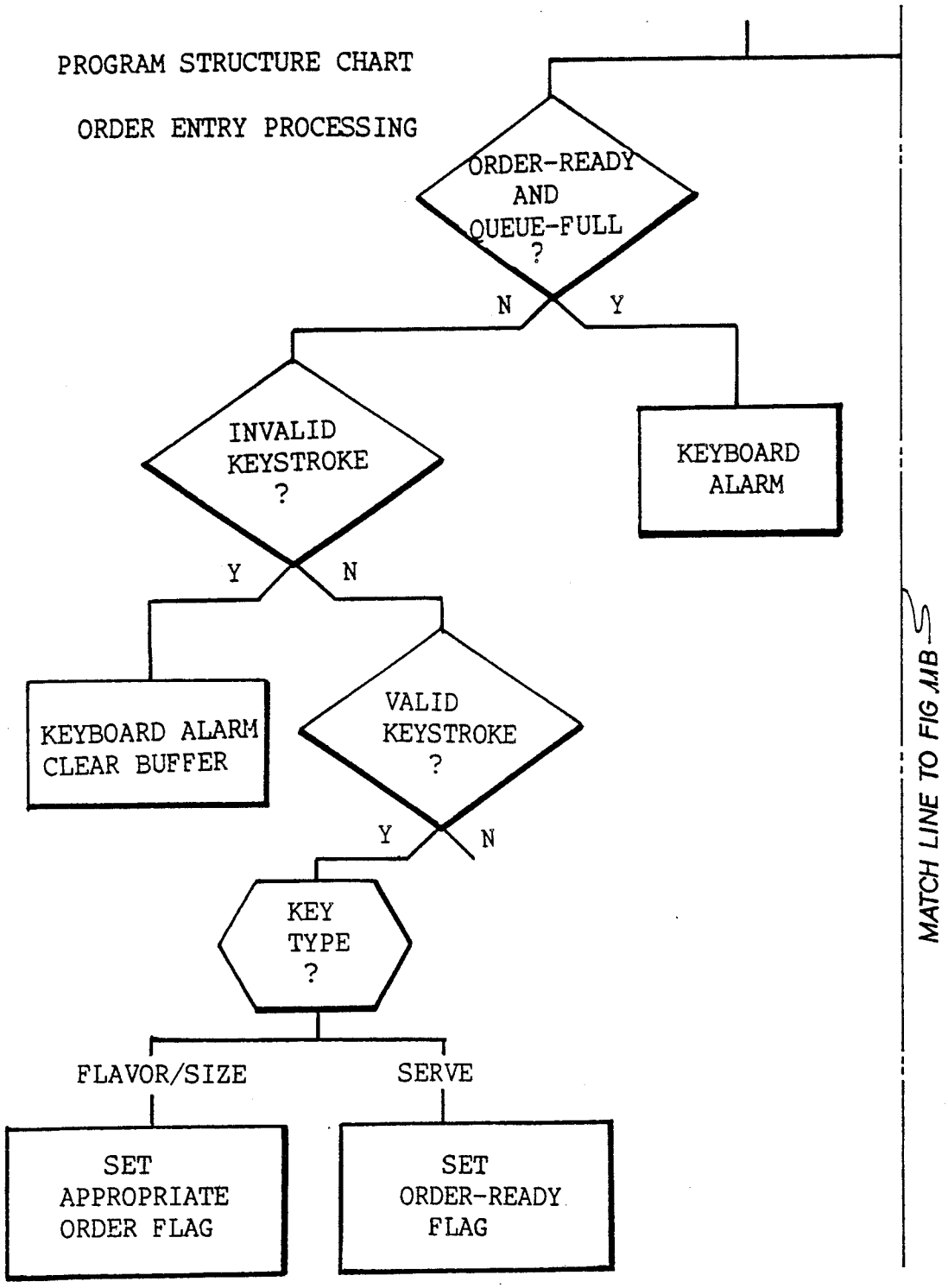
FIGS. 11 and 12A–D show the control logic implemented in certain blocks in FIG. 10.
Figure 11B:
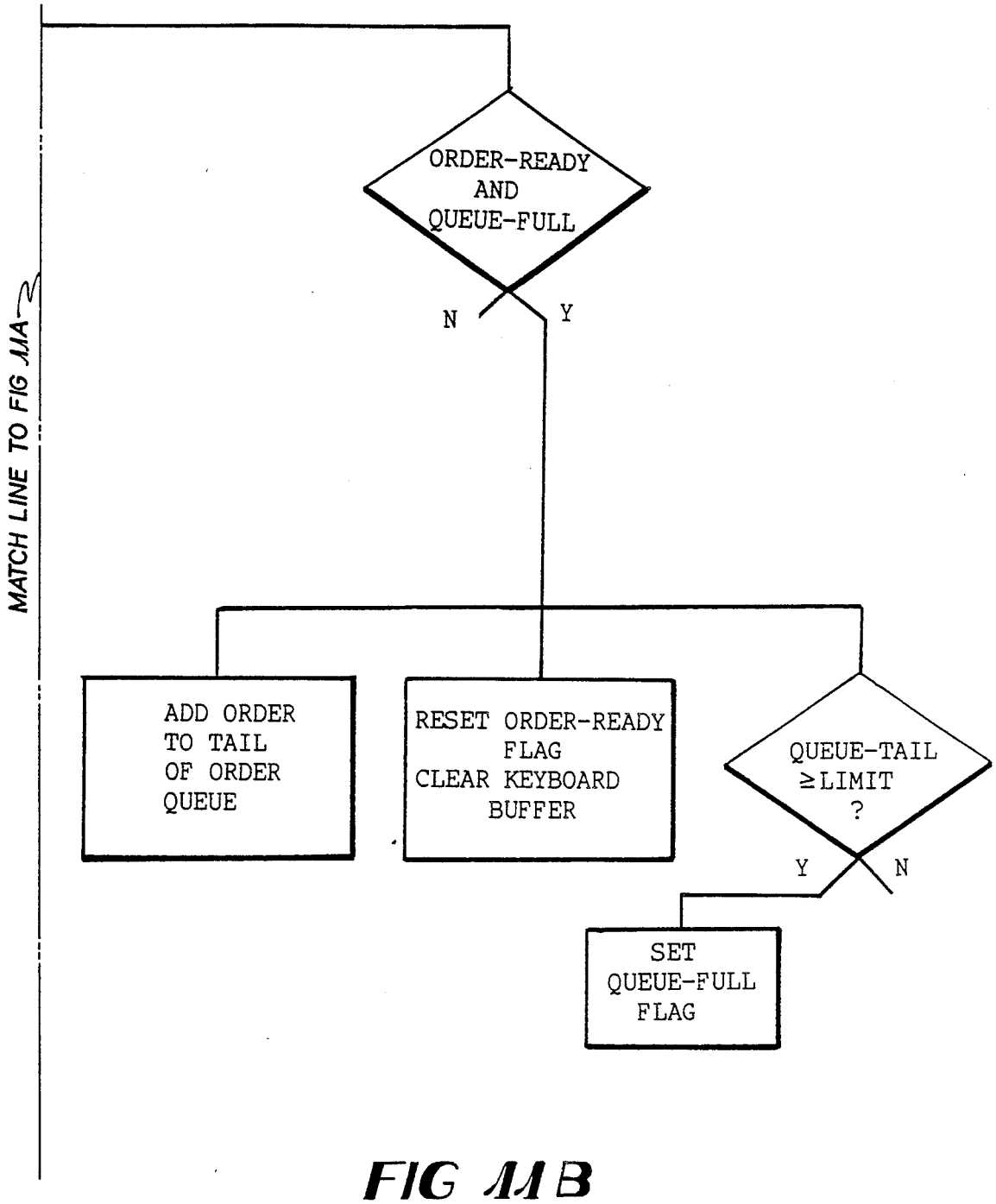
Figure 12A:
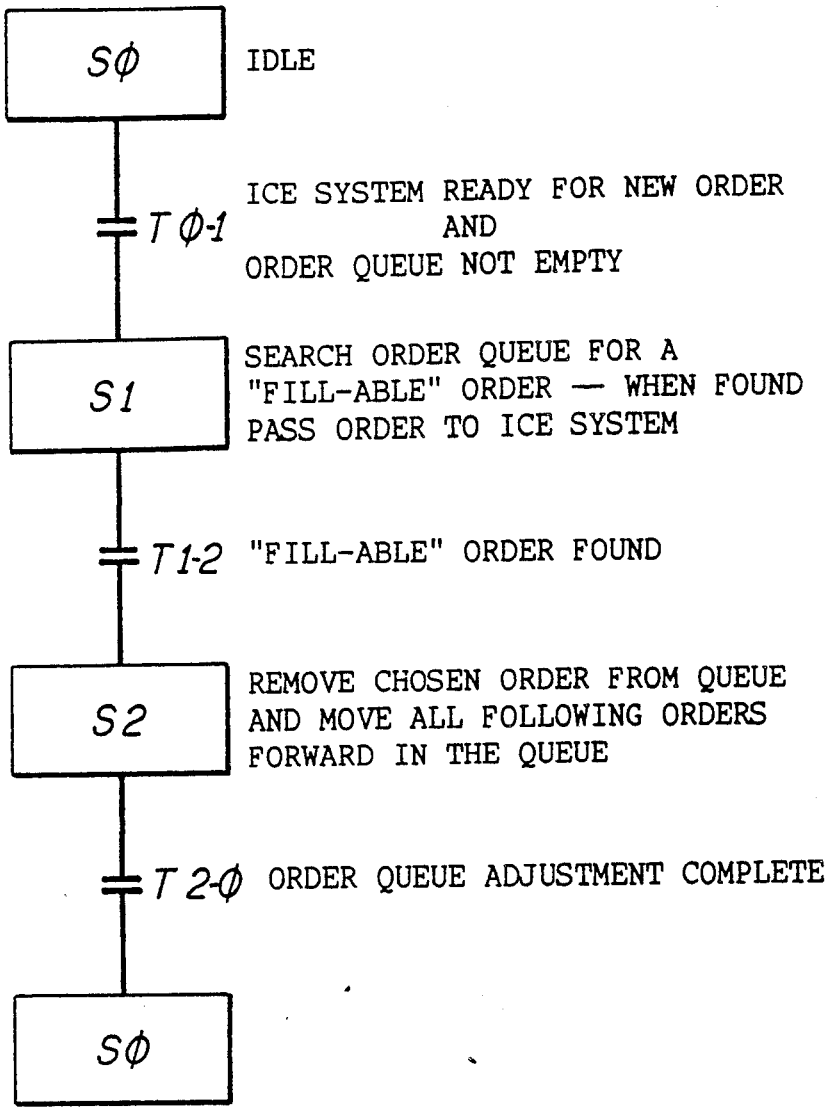
Figure 12B:
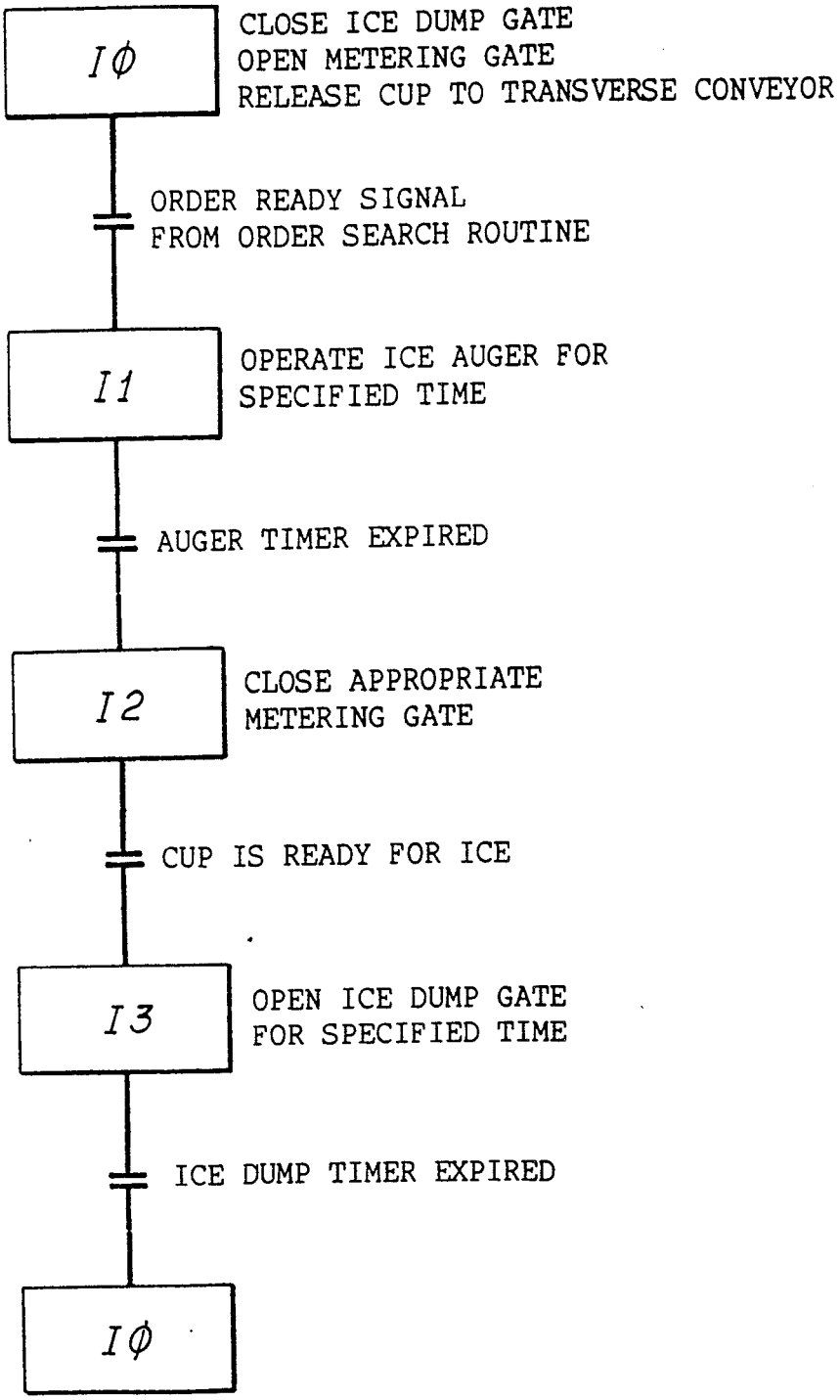
Figure 12C:
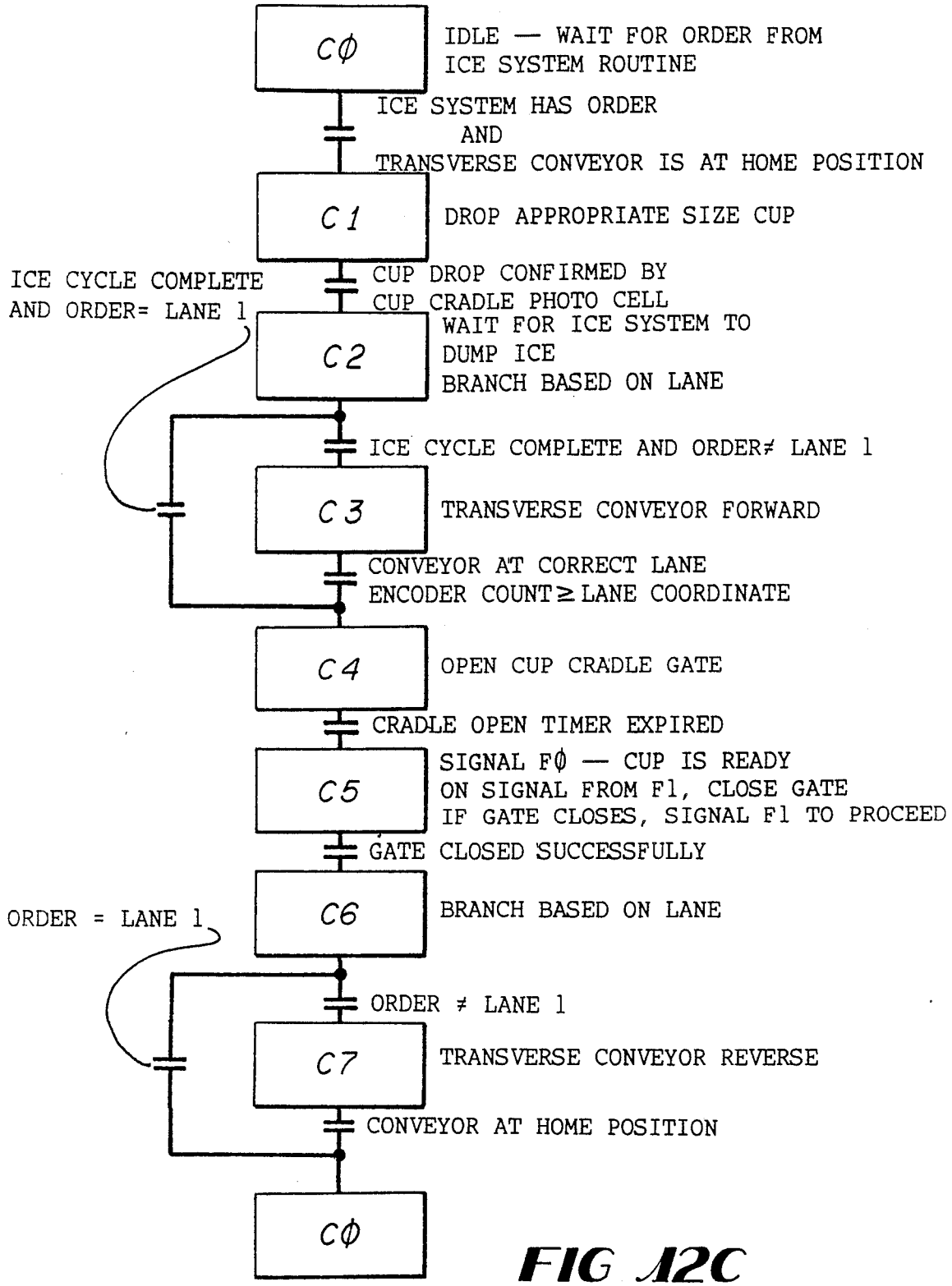
Figure 12D:
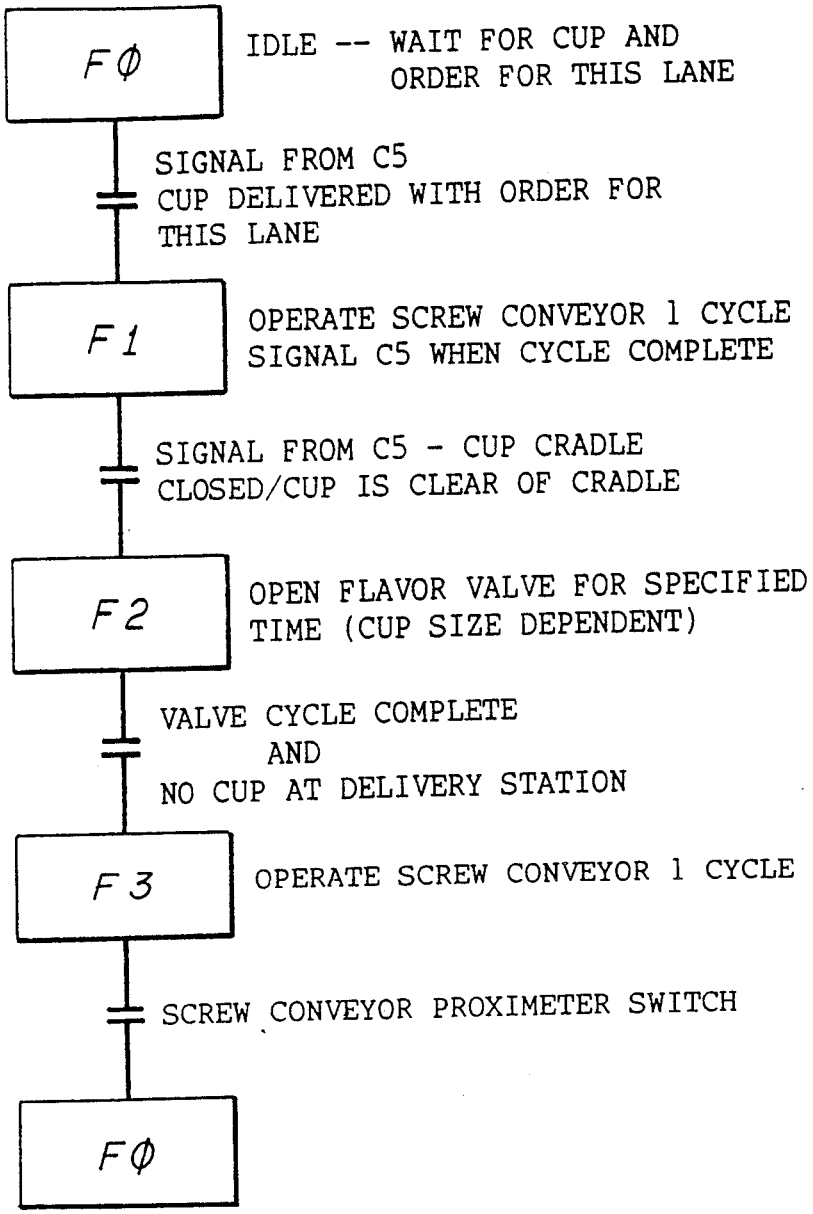
Figure 13A:
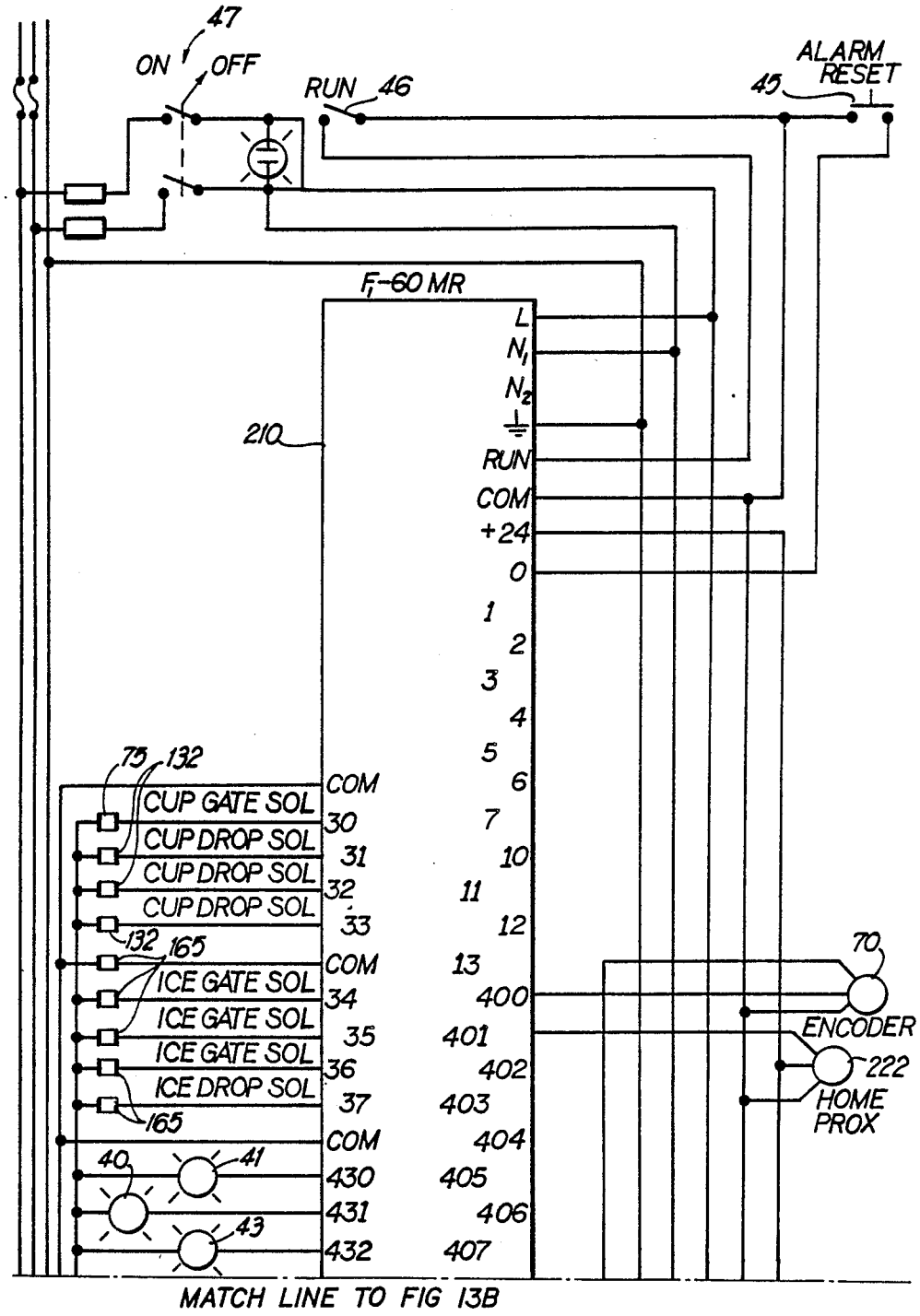
Figure 13B:
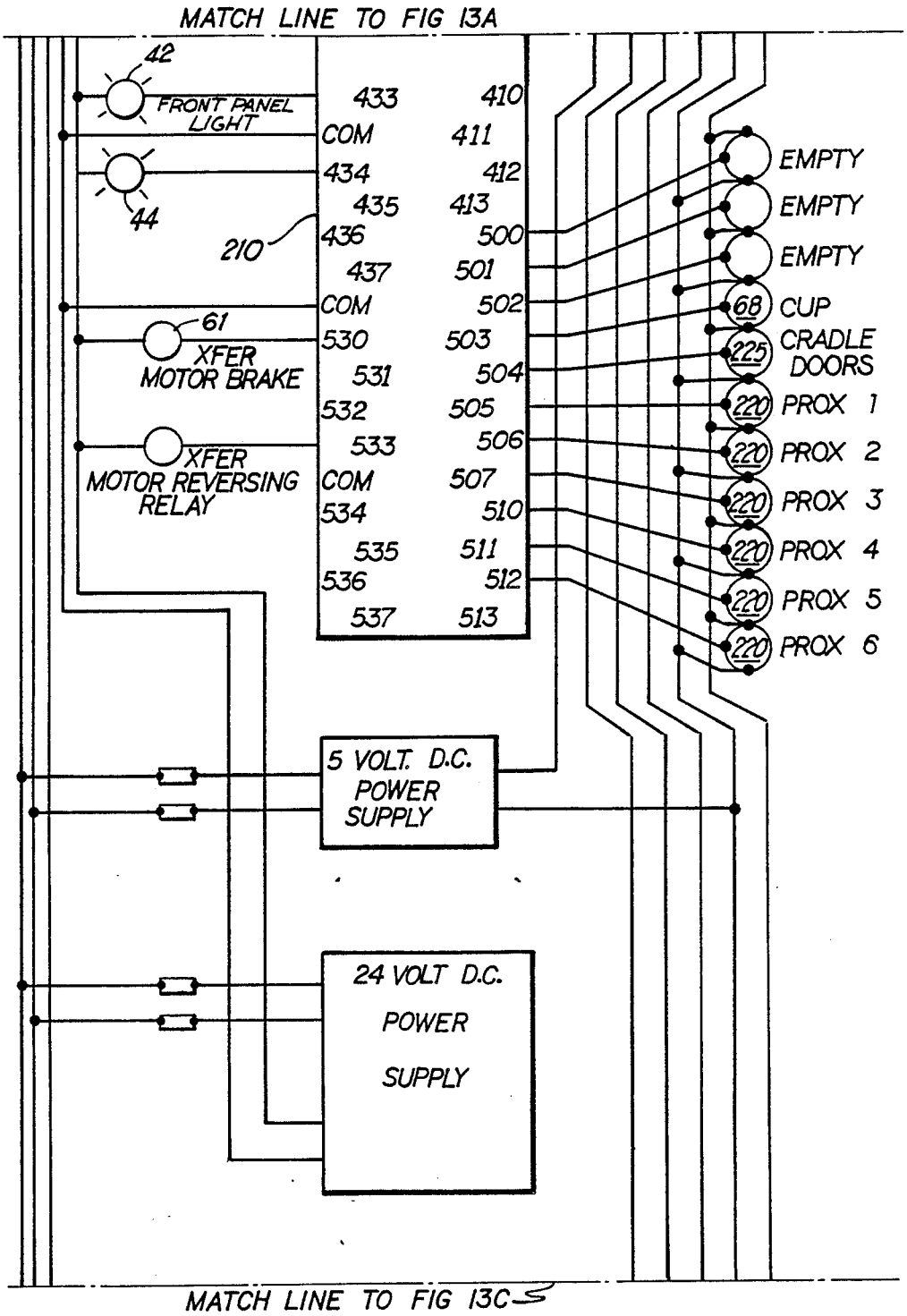

FIG. 10 is a block diagram of the control program, FIGS. 11 and 12 show the control logic, and FIGS. 13A, 13B and 13C are electrical wiring diagrams of the electrical control system of this invention.

As mentioned above with reference to FIG. 1, the automatic dispensing system of this invention includes the dispenser 10, a plurality of remote POS units 2 each with an order entry keyboard 4 and a PLC 8 (or programmable logic controller). The PLC 8 can be placed at any desired location including inside the housing 12, if desired. Any number of remote units 2 can be used, although only three are shown.

referring to FIGS. 13A–C, the controller used is a Mitsubishi model F-60-MR programmable logic controller 210 with a model F-40-ER extension unit 212. FIGS. 13A–C show the wiring to the various components of the dispenser 10 already described above.

With reference now to FIGS. 10–12, there are twelve separately functioning blocks of program code. The first two, "System Initialization" and "Transverse (First) Conveyor Motor Control," and a segment at the end of the program which monitors various processes for malfunctions and operates alarms, are straightforward implementations of traditional ladder logic, and no further explanation of their operation need be given. FIGS. 11 and 12 show the control logic implemented in each of the remaining program blocks shown in FIG. 10.

The controller processes the keystrokes entered by the operator at the order entry keyboard or POS unit 202, verifies that the sequence constitutes a valid order, and stores the order in the order queue, a section of controller memory capable of storing several orders until the dispenser 10 can fill them. The controller continuously fills the orders in the queue in the sequence entered as the dispensing stations are available, skipping the orders for which dispensing stations are not available, but returning to fill skipped orders as dispensing or fill stations 34 become available, always filling the oldest orders as soon as possible.

FIG. 11 shows the logic for the processing of the orders entered at the keyboard and placing them in the order queue for filling. An order consists of one flavor key operation and one cup size key operation and is confirmed by operation of the serve key or cancelled by operation of the cancel key. The flavor and size choices are stored in the keyboard buffer, an area of controller memory used to store the parts of the order until the entire order has been successfully entered. The operation is as follows: When the order queue is full and the keyboard buffer contains a complete order, the system cannot process any further orders, and indicates this state by sounding an alarm at the order entry keyboard and ignoring any keyboard input. If either of the flags is not set, the controller first checks that the keystroke is valid in the current context. If not, the keystroke is ignored and the keyboard buffer is cleared. If a valid flavor or size keystroke has been entered, the appropriate flavor or size flag is set in the keyboard buffer. If the serve key has been pressed and the order queue is not full, the current order in the keyboard buffer is transferred to the tail of the order queue and the keyboard buffer is cleared.

The remainder of the control program consists of nine routines implemented with step transition logic for controlling the ice dispensing system, cup dispensing system, cup conveyors, and flavor valves. The routines run simultaneously and asynchronously with periodic handshaking as required to coordinate the order filling sequence FIG. 12A shows the step transition diagram for the order search routine. The operation is as follows: The system is initialized in idle step S0. When the ice system control program is in the idle step 10 and there is at least one order in the order queue, the routine searches for an order that can be filled. The routine reads an order in the order queue and checks that the cup size ordered is available and that the equipment for the flavor ordered is idle. If not, the next order in the queue is read and checked in the same manner, and so forth until an order is found which can be filled. When an order is found, the order data is transferred to a set of flags used by the ice routine and a signal is sent to the ice routine that a new order is ready. Then all orders behind the current order are moved forward one position, one by one, until the entire queue has been adjusted.

FIG. 12B shows the step transition diagram for the ice system control routine. The operation is as follows: The system is initialized in step 10. The ice dump gate is closed and the metering gates are open. When an order is ready to be filled, the ice auger is operated for a specified time, after which the metering gate appropriate to the cup size ordered is closed. When a signal is received from the cup/cradle routine that a cup is under the ice chute, the dump gate is opened to load the cup with ice. The dump gate is closed and the cup/cradle routine is signalled to proceed with filling the order.

FIG. 12C shows the step transition diagram for the cup/cradle system control routine. The operation is as follows: The system is initialized in step C0. When the ice system routine has an active order, the appropriate size cup is dropped. When the cradle photocell detects a successful cup drop, the cup/ cradle routine signals the ice system routine that the cup is ready and waits for a signal that the ice dump is complete. The first (or transverse) conveyor is then driven forward to deliver the cup to the appropriate forward conveYor (this step is omitted if the order is for lane 1). The cradle is opened and the cup allowed to drop to the conveyor surface. The routine signals the appropriate lane controller that a cup is at the head or transfer station of the screw conveyor, waits for a signal from the lane controller that the screw conveyor cycle has been completed, and attempts to close the cradle. If the cradle closes successfully as indicated by the cradle proximity switch, the lane controller is signalled to proceed with filling the order, and the transverse conveyor is returned to the cup drop position under the ice chute (again, this step is omitted if the conveyor is at lane 1).

FIG. 12D shows a typical step transition diagram for a lane control routine. There are six lane control routines with similar logic, one for each of the six dispensing lanes. The six routines operate independently of each other and there is no communication or synchronization among them. The operation is as follows: The system is initialized in step F0. When a signal is received from step C5 that a cup has been delivered to this lane, the screw conveyor is operated for one revolution, bringing the cup to a position beneath the fill valve. When a signal is received from C5 that the cradle is successfully closed, indicating that the cup has cleared the cradle, the flavor valve is opened for a time appropriate to the cup size being filled. When the fill cycle is complete, the routine waits until the delivery station is vacant, as indicated by the lane photocell, and the screw conveyor is again operated for one revolution, moving the completed order to the delivery station, and returning the routine to the idle step, indicating to the order search routine that the lane is available to fill another order.

While the preferred embodiments of this invention have been described above in detail, it is to be understood that variations and modifications can be made therein without departing from the spirit and scope of the present invention. For example, other numbers and sizes of cups can be used, other numbers of valves and lanes can be used. The length of the cup support surfaces can be made longer to provide more cup pick-up stations, or other means to hold filled cups can be used. The valves can be single or multi-flavor valves and can be of any desired type, although they are preferably fast flow valves (i.e. 3 ounces per second flow rate). Other types of cup dispensers and ice bins and ice dispensers can be used. Other arrangements for the buttons can be used as desired. Other conveyor systems can be used in place of the ones shown. Rather than using manual ice refill, an automatic system can be used, if desired. Although the dispenser normally operates automatically from remote point of sale units having buttons for different flavors and cup sizes, the dispenser can also be operated manually using buttons on the dispenser itself. While the cup drop station is preferably also the transfer station of the rightmost screw conveyor, it can alternatively be located elsewhere and remote from all of the screw conveyors. Also, while the ice is dispensed into the cup at the cup drop station, this is not essential; it can be dropped at a separate ice drop station, such as at the transfer station of the second screw conveyor.

What is claimed is:

1. An automatic beverage dispensing system comprising:

(a) an automatic beverage dispenser;

(b) a plurality of point of sale units each with an order entry keyboard and being remote from said dispenser;

(c) programmable logic control means connected to both said dispenser and to said plurality of units for automatically operating said dispenser in response to selections made by operators on said keyboards;

(d) an automatic cup dropper assembly in said beverage dispenser including a plurality of cup holders each adapted to hold a plurality of different size cups, and including means for placing a cup of the desired size onto a cup drop station;

(e) an ice dispenser assembly in said beverage dispenser including an ice bin and an automatic ice dispenser for automatically dispensing a selected quantity of ice into a cup located at an ice drop station;

(f) means for automatically moving a dropped cup to a beverage fill station;

(g) a beverage dispensing valve located at said fill station and means for automatically dispensing a selected beverage into a cup located at said beverage fill station; and (h) means for moving beverage filled cups from said fill station to a pick-up station.

2. The apparatus as recited in claim 1 including a plurality of each of said beverage fill station, said beverage dispensing valve, and said pick-up station and including a cup cradle, a transverse conveyor for moving said cup cradle, a plurality of parallel cup lanes each having one of aid plurality of beverage fill stations and one of said plurality of pick-up stations, and said plurality of cup lanes each including a forward conveyor for moving a cup placed thereon at a transfer station thereof forward to said beverage fill station thereof and then forward to said pickup station thereof, one of said plurality of beverage dispensing valves being located above one each of said plurality of lanes at the fill station thereof, said cup dropper assembly including means for dropping a cup into said cradle at said cup drop station, and said cradle including means for dropping a cup therefrom onto one of said lane at said transfer station thereof.

3. The apparatus as recited in claim 2 wherein said transverse conveyor runs perpendicular to said forward conveyors and passes over said transfer stations thereof.

* * * * *